US009512755B2

(12) United States Patent
Szepessy et al.

(10) Patent No.: US 9,512,755 B2
(45) Date of Patent: Dec. 6, 2016

(54) CENTRIFUGAL SEPARATOR

(75) Inventors: Stefan Szepessy, Huddinge (SE); Olle Törnblom, Tumba (SE)

(73) Assignee: ALFA LAVAL CORPORATE AB, Lund (SE)

( * ) Notice: Subject to any disclaimer, the term of this patent is extended or adjusted under 35 U.S.C. 154(b) by 62 days.

(21) Appl. No.: 13/639,653

(22) PCT Filed: Apr. 5, 2011

(86) PCT No.: PCT/SE2011/050398

§ 371 (c)(1),
(2), (4) Date: Dec. 4, 2012

(87) PCT Pub. No.: WO2011/126436

PCT Pub. Date: Oct. 13, 2011

(65) Prior Publication Data

US 2013/0067873 A1 Mar. 21, 2013

(30) Foreign Application Priority Data

Apr. 9, 2010 (SE) ..... 1050350

(51) Int. Cl.
*F01M 13/04* (2006.01)
*B04B 5/00* (2006.01)
(Continued)

(52) U.S. Cl.
CPC ..... *F01M 13/04* (2013.01); *B04B 5/005* (2013.01); *B04B 5/06* (2013.01); *B04B 5/08* (2013.01);
(Continued)

(58) Field of Classification Search
CPC ..... B04B 1/08; B04B 5/005; B04B 5/08; B04B 5/12; B04B 5/06; B04B 9/12; B04B 9/02; B04B 2005/125; F01M 13/04; F01M 13/0416; F01M 2013/0422
(Continued)

(56) References Cited

U.S. PATENT DOCUMENTS 1,420,665 A * 6/1922 Newcombe ..... 55/408
2,344,068 A * 3/1944 Waseige ..... 55/408
(Continued)

FOREIGN PATENT DOCUMENTS

CN 101384329 A 3/2009
DE 10163924 A1 7/2003
(Continued)

OTHER PUBLICATIONS

EP 1645320 A1 as translated by Google.*
(Continued)

*Primary Examiner* — Duane Smith
*Assistant Examiner* — Stephen Hobson
(74) *Attorney, Agent, or Firm* — MKG, LLC

(57) ABSTRACT

A device for cleaning of polluted gas from a combustion engine, includes a centrifugal separator with a centrifuge rotor arranged to cause the polluted gas to rotate. The centrifuge rotor comprises a stack of truncated conical separating discs disposed at mutual spacing so they delimit intermediate spaces between them for the gas to flow through. An outlet chamber is disposed centrally within the stack of separating discs, whereby the centrifuge rotor is configured for counterflow separation. The centrifugal separator comprises a gas outlet which communicates with the outlet chamber. The stack of separating discs is disposed for rotation in a space formed within the combustion engine and arranged to receive the polluted gas, to which end the intermediate spaces between the separating discs communicate directly with the space, and the gas outlet is arranged to
(Continued)

conduct the cleaned gas out from the space through a wall which delimits the space.

21 Claims, 2 Drawing Sheets

(51) Int. Cl.
*B04B 5/08* (2006.01)
*B04B 5/12* (2006.01)
*B04B 9/12* (2006.01)
*B04B 5/06* (2006.01)
*B04B 9/02* (2006.01)

(52) U.S. Cl.
CPC . *B04B 5/12* (2013.01); *B04B 9/02* (2013.01); *B04B 9/12* (2013.01); *F01M 13/0416* (2013.01); *B04B 2005/125* (2013.01); *F01M 2013/0422* (2013.01)

(58) Field of Classification Search
USPC ..... 55/405
See application file for complete search history.

(56) References Cited

U.S. PATENT DOCUMENTS 3,022,776 A * 2/1962 Steinlein et al. ..... 123/73 A
4,329,968 A * 5/1982 Ishikawa ..... F01M 13/04 123/192.1
4,723,529 A 2/1988 Yokoi et al.
5,129,371 A * 7/1992 Rosalik, Jr. ..... F01M 13/0416 123/41.86
5,487,371 A * 1/1996 Beckman ..... F01M 13/04 123/572
5,542,402 A * 8/1996 Lee ..... F01M 13/04 123/573
5,564,401 A * 10/1996 Dickson ..... F01M 13/023 123/573
5,746,789 A * 5/1998 Wright et al. ..... 55/306
5,954,035 A * 9/1999 Hofer ..... F01M 13/04 123/573
6,152,120 A * 11/2000 Julazadeh ..... F01M 13/04 123/572
6,216,453 B1 * 4/2001 Maurer ..... 60/307
6,364,822 B1 * 4/2002 Herman et al. ..... 494/49
6,536,211 B1 * 3/2003 Borgstrom ..... B01D 45/14 55/404
6,584,964 B1 * 7/2003 Seilenbinder ..... F01M 13/04 123/572
6,626,163 B1 * 9/2003 Busen ..... B01D 45/12 123/572
6,709,477 B1 * 3/2004 Håkansson ..... B01D 45/14 123/573
6,755,896 B2 6/2004 Szepessy et al.
6,925,993 B1 8/2005 Eliasson et al.
6,973,925 B2 * 12/2005 Sauter et al. ..... 123/572
7,033,411 B2 * 4/2006 Carlsson et al. ..... 55/406
7,052,529 B2 * 5/2006 Franzen et al. ..... 95/270
7,056,363 B2 * 6/2006 Carlsson et al. ..... 55/406
7,152,589 B2 12/2006 Ekeroth et al.
7,250,066 B2 * 7/2007 Seipler ..... 55/337
7,338,546 B2 * 3/2008 Eliasson et al. ..... 55/406
7,445,653 B2 * 11/2008 Trautmann et al. ..... 55/345
7,632,326 B2 * 12/2009 Stemmer ..... 55/400
7,811,347 B2 * 10/2010 Carlsson et al. ..... 55/406
7,927,395 B2 * 4/2011 Szepessy et al. ..... 55/406
8,075,655 B2 * 12/2011 Anderson et al. ..... 55/400
8,123,829 B2 * 2/2012 Sato et al. ..... 55/385.3
8,172,917 B2 * 5/2012 Kup et al. ..... 55/406
8,191,537 B1 * 6/2012 Moy ..... F01M 13/04 123/572
8,714,132 B2 * 5/2014 Baumann et al. ..... 123/196 A
2002/0026928 A1 * 3/2002 Korenjak ..... F01M 11/02 123/572
2002/0032088 A1 * 3/2002 Korenjak ..... F01B 1/12 474/14
2002/0033295 A1 * 3/2002 Korenjak ..... F01B 1/12 180/292
2002/0112710 A1 * 8/2002 Akiwa ..... F01M 13/04 123/572
2003/0000508 A1 * 1/2003 Takahashi ..... F01M 13/022 123/572
2003/0019484 A1 * 1/2003 Lepp ..... F01M 13/04 123/572
2003/0070982 A1 * 4/2003 Baek ..... B01D 19/0057 210/512.1
2003/0178014 A1 * 9/2003 Sauter ..... B04B 5/12 123/572
2003/0233932 A1 * 12/2003 Ekeroth ..... B01D 45/14 95/12
2004/0025482 A1 * 2/2004 Borgstrom et al. ..... 55/438
2004/0107681 A1 * 6/2004 Carlsson et al. ..... 55/406
2004/0144071 A1 * 7/2004 Hilpert ..... F01M 13/04 55/406
2004/0159085 A1 * 8/2004 Carlsson et al. ..... 55/406
2004/0168415 A1 * 9/2004 Hilpert ..... B01D 45/16 55/406
2005/0120685 A1 * 6/2005 Fischer ..... B01D 45/14 55/406
2005/0121262 A1 * 6/2005 Berger ..... F01M 13/04 184/6.21
2006/0075998 A1 * 4/2006 Shieh ..... B01D 45/16 123/573
2006/0090738 A1 * 5/2006 Hoffmann ..... F01M 13/04 123/573
2006/0226155 A1 * 10/2006 Roche ..... F01M 13/04 220/563
2006/0249128 A1 * 11/2006 Shieh ..... F01M 13/0011 123/572
2007/0294986 A1 * 12/2007 Beetz ..... F01L 1/047 55/385.3
2008/0041324 A1 * 2/2008 Matsushima ..... F01M 13/022 123/41.21
2008/0135030 A1 * 6/2008 Knaus ..... F01M 13/0416 123/572
2008/0264251 A1 * 10/2008 Szepessy ..... B01D 45/14 95/35
2009/0000300 A1 * 1/2009 Hilpert ..... B01D 45/14 60/624
2009/0025562 A1 * 1/2009 Hallgren ..... B01D 45/14 96/216
2009/0025662 A1 * 1/2009 Herman ..... F01M 13/04 123/41.86
2009/0044791 A1 * 2/2009 Rice ..... F01M 13/04 123/574
2009/0205618 A1 * 8/2009 Hirota ..... F01M 13/04 123/572
2009/0223496 A1 * 9/2009 Borgstrom ..... B01D 45/14 123/573
2009/0241920 A1 * 10/2009 Inge ..... B01D 45/14 123/573
2009/0266346 A1 * 10/2009 Wagner ..... F01M 9/02 123/573
2009/0308249 A1 * 12/2009 Anderson ..... B01D 45/08 95/261
2010/0011723 A1 * 1/2010 Szepessy ..... B01D 45/14 55/438
2010/0043734 A1 * 2/2010 Holzmann ..... F01M 13/04 123/41.86
2010/0051388 A1 * 3/2010 Clark ..... B01D 46/30 184/6.24
2010/0126480 A1 * 5/2010 Shieh ..... F01M 13/04 123/573
2010/0180854 A1 * 7/2010 Baumann ..... B04B 5/005 123/196 A
2010/0232955 A1 * 9/2010 Schick et al. ..... 415/204
2011/0011380 A1 * 1/2011 Lagerlof ..... B01D 45/14 123/573
2011/0023849 A1 * 2/2011 Cattani ..... F02B 37/005 123/573

(56) References Cited

U.S. PATENT DOCUMENTS

| | | | | |
|---|---|---|---|---|
| 2011/0281712 | A1* | 11/2011 | Schlamann | B01D 45/14 494/7 |
| 2012/0318215 | A1* | 12/2012 | Copley | B01D 45/08 123/41.86 |
| 2013/0067873 | A1* | 3/2013 | Szepessy | B04B 5/005 55/385.1 |
| 2013/0125857 | A1* | 5/2013 | Mayr | F02M 25/025 123/25 A |
| 2014/0048052 | A1* | 2/2014 | Subedi | F02M 25/06 123/572 |
| 2014/0165977 | A1* | 6/2014 | Copley | B01D 45/08 123/573 |
| 2014/0230381 | A1* | 8/2014 | Tornblom | B04B 5/12 55/317 |
| 2014/0352539 | A1* | 12/2014 | Schleiden | F01M 13/04 95/272 |
| 2015/0020785 | A1* | 1/2015 | An | F01M 13/02 123/572 |
| 2015/0068172 | A1* | 3/2015 | Andersson Aginger | B01D 45/14 55/385.3 |
| 2015/0114368 | A1* | 4/2015 | Kurita | F01M 13/04 123/573 |
| 2015/0119226 | A1* | 4/2015 | Pogen | B04B 5/12 494/84 |
| 2015/0159596 | A1* | 6/2015 | Wakiya | F01M 13/00 123/41.86 |
| 2015/0167591 | A1* | 6/2015 | Sato | F02M 25/06 123/403 |
| 2015/0345351 | A1* | 12/2015 | Mincher | B01D 45/08 55/462 |
| 2015/0361839 | A1* | 12/2015 | Kimura | F01M 5/002 123/196 A |
| 2016/0024984 | A1* | 1/2016 | Galeazzi | F01M 13/04 123/573 |
| 2016/0082378 | A1* | 3/2016 | Ishida | B01D 45/14 55/403 |
| 2016/0177791 | A1* | 6/2016 | Kira | F01M 13/04 123/573 |

FOREIGN PATENT DOCUMENTS

| | | | | |
|---|---|---|---|---|
| DE | 10350562 | A1 * | 6/2005 | F01M 1/10 |
| EP | 1273335 | B1 | 1/2003 | |
| EP | 1645320 | | 4/2006 | |
| EP | 1645320 | A1 * | 4/2006 | |
| EP | 1772193 | A1 | 4/2007 | |
| EP | 1772193 | B1 * | 4/2008 | |
| EP | 1963631 | | 1/2010 | |
| GB | 2317203 | A | 3/1998 | |
| JP | 57-002411 | A | 1/1982 | |
| JP | 04-153514 | A | 5/1992 | |
| JP | H08-284634 | A | 10/1996 | |
| JP | 10-274024 | A | 10/1998 | |
| JP | 2000-45749 | A | 2/2000 | |
| JP | 2005-042698 | A | 2/2005 | |
| JP | 2008-155093 | A | 7/2008 | |
| RU | 2310760 | C2 | 11/2007 | |
| RU | 2315872 | C2 | 1/2008 | |
| SE | 519180 | C2 | 1/2003 | |
| SE | 529409 | C2 | 8/2007 | |
| WO | 01-36103 | A1 | 5/2001 | |
| WO | 2004024297 | A1 | 3/2004 | |
| WO | 2007/073320 | A1 | 6/2007 | |
| WO | WO 2008005481 | A3 * | 3/2008 | |
| WO | WO 2009065660 | A1 * | 5/2009 | |
| WO | WO 2009010248 | A3 * | 6/2009 | |

OTHER PUBLICATIONS

International Search Report for International Application No. PCT/SE2011/050398, dated Aug. 3, 2011.

International Preliminary Report on Patentability for International Application No. PCT/SE2011/050398, dated Jun. 29, 2012.

First Office Action for Japanese Patent Application No. 2013-50371, dated Oct. 1, 2013.

* cited by examiner

CENTRIFUGAL SEPARATOR

TECHNICAL FIELD

The present invention relates to a device for cleaning of polluted gas from a combustion engine, e.g. crankcase gas vented from a crankcase of a combustion engine, and in particular to a centrifugal separator for removal of pollutants suspended in the polluted gas in the form of solid or liquid particles.

BACKGROUND

Crankcase gas usually contains pollutants in the form of soot particles and/or oil mist.

EP 1273335 B1 describes such a known device for cleaning of crankcase gas. The centrifugal separator of the known device has a stationary housing which delimits within it a chamber in which the centrifuge rotor is arranged to rotate. The centrifugal separator is arranged to be fastened to the side of the combustion engine, and an external feed line is provided to lead crankcase gas from the engine to an inlet provided on the housing and communicating with the centrifuge rotor. During operation, the pollutants are separated from the crankcase gas by the rotating centrifuge rotor, and the housing has accordingly an outlet for the separated pollutants (oil and soot) and a gas outlet for the cleaned gas.

SE 529 409 C2 refers to a similar device for cleaning of crankcase gas. This centrifugal separator has a stationary housing which encloses the centrifuge rotor and which has an interface surface configured for direct mounting of the housing on a valve cover of the combustion engine. The interface surface is provided with a gas inlet which, via an aperture in the valve cover, communicates directly with the crankcase gas in a space defined by the valve cover. Such a configuration results in no need to provide an external crankcase gas feed line. The housing comprises also a gas outlet for the cleaned gas and a special gathering trough for the separated pollutants.

The prior art device has proved to be very effective for cleaning of polluted gas. Within the vehicle industry there are constantly increasing environmental requirements with a view to reducing emissions to the environment. The devices indicated above are traditionally used for cleaning of crankcase gas from large diesel engines. There is however a need to clean also crankcase gas from smaller combustion engines, e.g. diesel engines of the order of 5 to 9 liters or still smaller engines for passenger cars. At the same time, the automotive industry sets high requirements in terms of compact and cost-effective solutions exhibiting high performance.

SUMMARY OF THE INVENTION

An object of the present invention is to wholly or at least partly meet the above need.

According to the present invention, there is provided a device for cleaning polluted gas including a stack of separating discs on a centrifuge rotor, disposed for rotation in a space which is formed within a combustion engine and which is arranged to receive the polluted gas. The intermediate spaces between the separating discs communicate directly with the space, and the gas outlet is arranged to conduct the cleaned gas out from the space through a wall which delimits the space.

The device according to the invention thus utilises a space already present within the combustion engine. For cleaning of crankcase gas it is for example possible for such a space to take the form of the crankcase or a formed space situated within the engine block and communicating with the crankcase. Other possible spaces are those delimited by various kinds of covers belonging to the engine, e.g. the space within a valve cover, a timing chain case or a flywheel housing. For crankcase gas cleaning purposes, such spaces may be arranged to communicate with the crankcase through channels in the engine block. The space formed within the engine thus constitutes a delimited space for the centrifuge rotor. This means that the centrifugal separator needs neither a separate housing of its own to enclose the centrifuge rotor nor a separate feed line of its own to supply polluted gas to the centrifuge rotor. The device according to the invention occupies hardly any space outside the engine, since the whole or substantially the whole of the centrifugal separator is accommodated in the existing engine space. Nor does the centrifugal separator need to be provided with any outlet device for the pollutants separated from the gas. Instead, the centrifuge rotor is arranged, as a result of the counterflow separation, to propel the separated pollutants radially outwards from the stack of separating discs and directly back to the space which already contains polluted gas.

The centrifuge rotor may with advantage be situated in the space at such spacing from the delimiting wall that the polluted gas can flow relatively freely along the whole axial extent of the stack. This creates good conditions for the polluted gas to be distributed equally (homogeneously) to all the intermediate spaces between the separating discs. Owing to the limited space around a combustion engine, the prior art centrifugal separator is so configured that said stationary housing surrounds it relatively closely, i.e. the centrifugal separator is configured with a relatively small annular space between the centrifuge rotor and its surrounding housing. Such a small annular space may result in flow resistance causing uneven distribution of the polluted gas to the intermediate spaces in the stack of separating discs. The invention can therefore make improved separation performance possible in that the free flow along the whole stack of separating discs results in a more even distribution of the polluted gas to all the intermediate spaces between the separating discs.

Consequently, the invention proposes a device which results in effective cleaning of polluted gas from a combustion engine and which is both simple and compact.

According to an embodiment of the invention, the drive device is so arranged that the speed of the centrifuge rotor is variable relative to the speed of the combustion engine. By speed control, the centrifuge rotor speed and hence the cleaning effect can be adjusted as necessary. The centrifuge rotor may for example be drivingly connected to a shaft of the engine, wherein the drive device comprises means for a variable transmission ratio between said shaft and the centrifuge rotor so that the speed of the centrifuge rotor can be varied relative to the speed of the shaft and the engine.

According to another embodiment of the invention, the drive device is a motor. In this case the centrifuge rotor is driven by a motor of its own which is independent of the speed of the combustion engine. Such a motor also allows the possibility of speed control of the centrifuge rotor, which may for example be achieved by an electric motor operatively connected to a control unit for speed control of the electric motor and hence of the centrifuge rotor. The speed of a pneumatic or hydraulic motor may also be controlled by control of the flow of pressurised gas or liquid to the pneumatic or hydraulic motor.

According to another embodiment of the invention, the drive device is situated outside the space. The drive device is thus isolated from the space which contains polluted gas, which means for example that an electric motor can be protected from a relatively dirty and aggressive environment which contains oil mist, soot and other pollutants.

According to a further embodiment of the invention, a bearing unit is provided in the delimiting wall of the space, to rotatably support the centrifuge rotor in the wall. The wall is thus used as support for the centrifuge rotor. A further bearing unit may be provided in the space, in which case the bearing units are adapted to rotatably supporting the centrifuge rotor on their respective sides of the stack of separating discs. This results in relatively rigid journalling of the centrifuge rotor, whereby harmful vibrations and oscillations can be avoided during its rotation.

According to another embodiment of the invention, the centrifuge rotor is drivingly connected to the drive device via a rotor shaft which extends through a shaft lead-through in the delimiting wall of the space, the shaft lead-through being configured with said bearing unit in the wall. This means that the shaft lead-through can be used to rotatably support the centrifuge rotor in the wall.

According to a further embodiment of the invention, the centrifuge rotor is rotatably supported only in said bearing unit in the wall. This results in a simple support device for the whole centrifugal separator with only one bearing unit.

According to a further embodiment of the invention, the gas outlet communicates with the outlet chamber via an axial end wall which is situated on the stack of separating discs distally from said bearing unit in the wall. The gas outlet is thus disposed in the space on one axial side of the stack of separating discs, and the bearing unit is situated in the wall on the other axial side of the stack of separating discs.

According to a further embodiment of the invention, the gas outlet communicates with the outlet chamber via an axial end wall which is situated on the stack of separating discs proximally about said bearing unit in the wall. Both the gas outlet and the bearing unit are thus situated on the same axial side of the stack of separating discs.

According to a further embodiment of the invention, the gas outlet has the form of a tubular element which surrounds said bearing unit in the wall and which is connected to the delimiting wall of the space, which gas outlet forms an outlet duct in which a bearing support of the bearing unit is so arranged that cleaned gas can be conducted past the bearing support in the outlet duct. The result is a gas outlet combined with a bearing unit for rotatably supporting the centrifuge rotor in the wall.

According to a further embodiment of the invention, the motor is an electric motor. It is relatively easy to arrange a speed control for an electric motor. The electric motor is preferably situated outside the space so that it is isolated from the space containing the polluted gas and is therefore protected from the relatively dirty environment.

According to a further embodiment of the invention, the motor is a hydraulic or pneumatic motor arranged to rotate the centrifuge rotor by means of a fluid which is pressurised by the combustion engine during operation. Such a fluid may for example be compressed air or pressurised lubricant (oil) from an already present compressed air or lubricant system of a combustion engine for a vehicle, e.g. a truck.

According to a further embodiment of the invention, the motor comprises a turbine situated in the space and connected to the centrifuge rotor, which motor comprises a duct for supply of said pressurised fluid to an orifice provided in the space and directed towards the turbine in order to cause the turbine wheel and hence the centrifuge rotor to rotate. This means that the space can also be used for driving the centrifuge rotor. Pressurised lubricant (oil) may preferably be used as said pressurised fluid, since the space for the polluted gas is usually also configured to contain lubricant and/or to return said lubricant to, for example, the crankcase.

According to a further embodiment of the invention, the centrifugal separator comprises a fan situated downstream of the stack of separating discs and adapted to compensating for the pressure drop associated with the gas flow through the centrifuge rotor. In this case the gas outlet may be provided with a fan housing surrounding a fan impeller mounted on a rotor shaft which belongs to the centrifuge rotor and extends into the fan housing. In a counterflow separator, the centrifuge rotor exerts a pumping action on the gas flow in a direction opposite to the desired direction of flow, resulting in flow resistance through such a centrifuge rotor during operation. The rotating fan thus draws crankcase gas through the centrifuge rotor during operation. Excessive gas pressure in the space is thus avoided.

According to a further embodiment of the invention, the space formed within the combustion engine is delimited by a cover on the engine. Said wall delimiting the space may thus take the form of a valve cover, timing chain case, flywheel housing or the like. Such a cover arranged to delimit a space for receiving crankcase gas is prior art and not further described here.

According to another embodiment of the invention, the polluted gas is crankcase gas vented from a crankcase of the combustion engine. This means that the crankcase gas from the engine can be cleaned by the device. To this end, the space formed within the engine may be its crankcase or a space formed within the engine block and arranged to communicate with the crankcase.

BRIEF DESCRIPTION OF THE DRAWINGS

The invention is explained in more detail below by a detailed description of embodiments of the invention described by way of examples with reference to the attached drawings.

DETAILED DESCRIPTION

Figure 1:
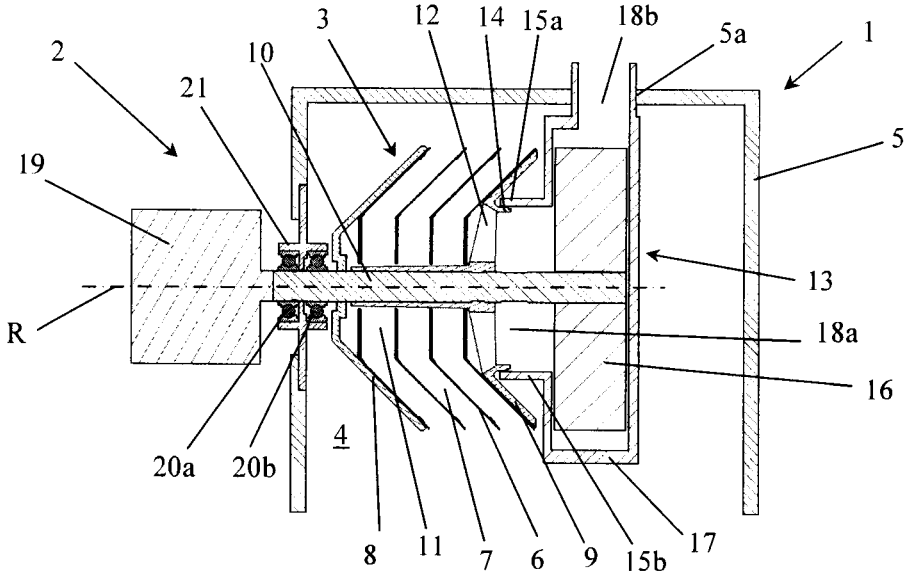
FIG. 1 shows a device according to a first embodiment of the invention.
Figure 2:
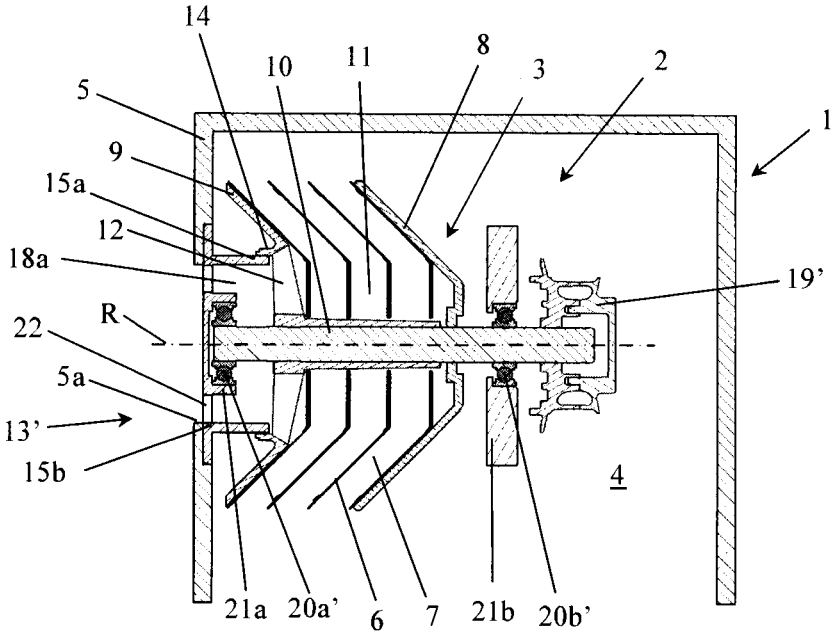
FIG. 2 shows a device according to a second embodiment of the invention.
Figure 3:
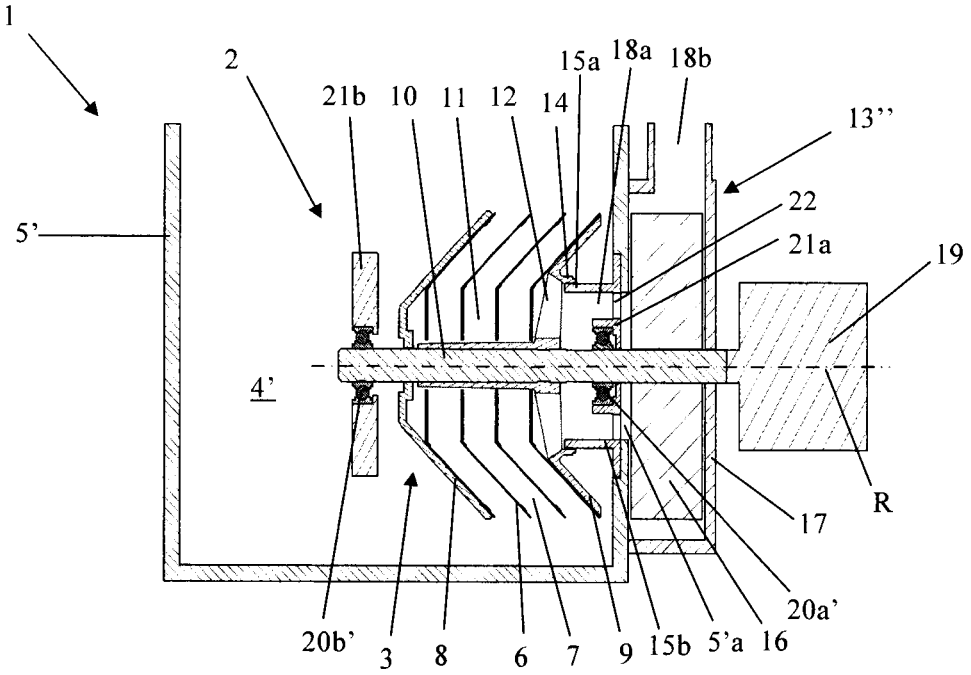
FIG. 3 shows a device according to a third embodiment of the invention.

FIGS. 1-3 show various embodiments of a device for cleaning of polluted gas from a combustion engine. In the embodiments shown, the polluted gas is crankcase gas vented from a crankcase of the engine. The device 1 comprises a centrifugal separator 2 for separation of particulate pollutants from the crankcase gas. The centrifugal separator 2 comprises a centrifuge rotor 3 which is rotatable about a rotational axis R and which is disposed in a space 4 and 4' formed within the engine, i.e. a space which belongs to the engine. In a first and second embodiment according to FIG. 1 and FIG. 2 respectively, the space 4 is delimited by a valve cover 5 of the engine, which space 4 within the valve cover 5 is arranged to receive crankcase gas from the crankcase. The engine thus comprises an engine block provided with channels which are arranged to conduct the crankcase gas from the crankcase to the space 4 delimited by the valve cover 5. In a third embodiment according to FIG. 3 the centrifuge rotor 3 is rotatably arranged directly within the crankcase 5', i.e. in the space 4' delimited by the crankcase 5'.

In the space 4, 4' the centrifuge rotor 3 is provided with a stack of separating discs 6 disposed at mutual spacing so that they delimit between them intermediate spaces 7 for crankcase gas to flow through. Such intermediate spaces 7 may be formed by providing a number of spacing members (not shown) on the surfaces of the separating discs. For the sake of clarity, the drawing shows only a small number of separating discs 6 with large axial intermediate spaces 7. In practice, significantly more separating discs 6 are stacked, with the result that relatively thin intermediate spaces 7 are formed between them. The stack of separating discs is disposed in the space 4 and 4' in such a way that the intermediate spaces 7 between the separating discs 6 communicate directly with the space 4 and 4'. The separating discs 6 are of truncated conical shape and stacked between a first end wall 8 and a second end wall 9 which are of truncated conical shape corresponding to the separating discs 6. A rotor shaft 10 extends coaxially with the rotational axis R through the stack of separating discs 6, and the separating discs 6 and the end walls 8, 9 are disposed concentrically and connected to the rotor shaft 10. Each end wall 8, 9 and each separating disc 6 therefore have a central planar portion with a hole for the rotor shaft 10.

Each separating disc 6 further has running through it, in the planar portion, gas flow apertures (not shown) distributed around the rotor shaft 10. The gas flow apertures in the separating discs 6 and the intermediate spaces 7 between the central planar portions of the separating discs together form a central outlet chamber 11 within the stack of separating discs 6.

Consequently, the centrifuge rotor 3 is arranged to clean crankcase gas by so-called counterflow separation, wherein polluted crankcase gas is led into intermediate spaces 7 between the separating discs 6, radially from outside the rotor 3, and thence towards the central outlet chamber 11. The central portion of the second end wall 9 has running through it a plurality of apertures 12 distributed around the rotor shaft 10 so that the central outlet chamber 11 can communicate with a stationary gas outlet 13, 13' and 13" in order to discharge cleaned crankcase gas from the centrifuge rotor 3. The second end wall 9 further has an annular flange 14 which extends axially towards the gas outlet 13, 13' and 13" and is arranged to cooperate with a similar annular flange 15*a* on a tubular element 15*b* on the gas outlet 13, 13' and 13". The cleaned crankcase gas is thus guided from the central outlet chamber 11 to the stationary gas outlet 13, 13' and 13".

In the first embodiment shown in FIG. 1, the stationary gas outlet 13 is disposed in the space 4 within the valve cover 5. A fan impeller 16 is provided at a first end of the rotor shaft 10 which extends into the gas outlet 13, and a portion of the gas outlet 13 which surrounds the fan impeller 16 is configured as a fan housing 17. The gas outlet 13 further comprises an outlet duct 18*b* connected to the fan housing 17 and arranged to conduct crankcase gas out from the space 4 through a duct lead-through or aperture 5 *a* in the valve cover 5. The fan impeller 16 in the gas outlet 13 is configured to pump crankcase gas from the outlet chamber 11 and out through the outlet duct 18*b* of the fan housing 17. In a counter flow separator, the stack of separating discs 6 exerts a pumping action on the gas flow in a direction opposite to the desired direction of flow, causing flow resistance or pressure drop through such a centrifuge rotor 3 during operation. The fan 16 is thus adapted to at least compensate for the pressure drop associated with the gas flow through the rotor 3.

FIG. 1 shows schematically an electric motor 19 which is drivingly connected to the centrifuge rotor 3 and mounted on the outside of the valve cover 5. The motor 19 is connected to a second end of the rotor shaft 10 which extends through a shaft lead-through in the valve cover 5. The shaft passage comprises a bearing unit with two bearings 20*a*, 20*b* and a bearing support 21 which are disposed in the valve cover 5 to rotatably support the centrifuge rotor 3 via the rotor shaft 10. Said two bearings 20*a* and 20*b* are disposed axially side by side in the bearing support 21. As illustrated in FIG. 1, the rotor shaft 10 is only journalled by the bearing unit associated with the shaft passage in the valve cover 5. The result is a simple support device for the whole of the centrifuge rotor 3. If so desired, however, a further bearing unit (not shown) may be provided within the gas outlet 13 at the first end of the rotor shaft 10 so that the centrifuge rotor 3 is supported on both sides of the stack of separating discs 6.

In the second embodiment shown in FIG. 2, the stationary gas outlet 13' takes the form of a tubular element 15*b* which defines an outlet duct 18*a* for cleaned crankcase gas. In the valve cover 5 there is an aperture 5*a* to which the outlet duct 18*a* connects so that cleaned crankcase gas can be conducted out from the space 4 within the valve cover 5. The tubular element 15*b* is connected directly to the valve cover 5 in the region around its aperture 5*a*, extends axially inwards towards the annular flange 14 on the second end wall 9 of the centrifuge rotor 3 and has a free end in the form of a cooperating annular flange 15*a*. As described above, the flanges 14 and 15*a* are arranged to cooperate in order to guide the cleaned crankcase gas from the central outlet chamber 11 in the centrifuge rotor 3 to the stationary gas outlet 13'.

FIG. 2 shows a first end of the rotor shaft 10 extending into the tubular element 15*b* which surrounds a bearing unit comprising a first bearing 20*a'* and a bearing support 21*a* which are arranged to rotatably support the rotor shaft 10 in the valve cover 5 via the tubular element 15*b*. In the tubular element 15*b*, the bearing support 21*a* is supported by a flange extending radially between the bearing support 21*a* and the tubular element 15*b* and having a plurality of holes 22 running through it which are distributed round the bearing support 21*a* and are arranged to conduct cleaned crankcase gas past the bearing support 21*a* in the outlet duct 18 *a*. A second end of the rotor shaft 10 is disposed in the space 4 and supports a turbine wheel 19'. The rotor shaft 10 is thus drivingly connected to a hydraulic motor which further comprises a nozzle (not shown) situated in the space 4 and arranged to direct towards the turbine wheel 19' a jet of liquid (e.g. pressurised oil) for rotation of the turbine impeller 19' and the centrifuge rotor 3. Between the stack of separating discs 6 and the turbine wheel 19', the rotor shaft 10 is journalled by a second bearing 20*b'* in a wall element 21*b* disposed in the space 4 within the valve cover 5. In the second embodiment, the centrifuge rotor 3 is thus rotatably supported on the respective sides of the stack of separating discs 6 by the first bearing 20*a'* and the second bearing 20*b'*.

In the third embodiment shown in FIG. 3, the centrifuge rotor 3 is disposed for rotation within a crankcase 5'. The space 4' within the crankcase 5' is arranged to contain oil in liquid form up to a certain level. However, the rotor 3 is disposed in the portion of the space 4' which is arranged to contain crankcase gas. Consequently, the centrifugal separator 2 shown is situated at a suitable distance above said oil level so that there is no risk of the centrifuge rotor 3 coming into contact with, or being filled with, the liquid oil.

FIG. 3 shows a stationary gas outlet 13" provided with a tubular element 15*b* which defines an outlet duct 18*a* for cleaned crankcase gas. In the crankcase 5' there is an aperture 5' *a* to which the outlet duct 18*a* connects so that cleaned crankcase gas can be conducted out from the space 4' within the crankcase 5'. The tubular element 15*b* is connected directly to the crankcase 5' in the region round its aperture 5' *a* and extends radially inwards towards the annular flange 14 on the second end wall 9 of the centrifuge rotor 3, and the free end of the tubular element 15*b* takes the form of the cooperating annular flange 15 *a*. As described above, the flanges 14 and 15*a* are arranged to cooperate in order to guide the cleaned crankcase gas from the central outlet chamber 11 in the centrifuge rotor 3 to the stationary gas outlet 13". The rotor shaft 10 extends axially through the tubular element 15*b* and out from the crankcase 5' through its aperture 5' *a*. Immediately outside the crankcase 5', the rotor shaft 10 supports a fan impeller 16, wherein the gas outlet 13" comprises a fan housing 17 which surrounds the fan impeller 16, is disposed outside the crankcase 5' and is arranged to communicate with said outlet duct 18*a* via the aperture 5' *a* in the crankcase 5'. The gas outlet 13" further comprises an outlet duct 18*b* connected to the fan housing 17 and arranged to conduct crankcase gas out from the fan housing 17. As previously described, the fan impeller 16 is configured to pump crankcase gas from the outlet chamber 11 in the centrifuge rotor 3 and out through the stationary gas outlet 13'. The fan impeller 16 may thus be adapted to at least compensate for said pressure drop associated with the gas flow through the centrifuge rotor 3. Alternatively, the fan impeller 16 may be totally omitted from this embodiment in cases where there is no need for the above pressure drop compensation.

FIG. 3 shows schematically an electric motor 19 drivingly connected to the centrifuge rotor 3 and mounted on the outside of the fan housing 17. The motor 19 is connected to a first end of the rotor shaft 10 which extends through a shaft lead-through in the fan housing 17. In the third embodiment, the centrifuge rotor 3 is journalled on both sides of the stack of separating discs 6. The portion of the rotor shaft 10 which extends into the tubular element 15*b* is journalled by a bearing unit comprising a first bearing 20*a'* and a bearing support 21*a* which are arranged to support the rotor shaft 10 for rotation in the crankcase 5' via the tubular element 15*b*. In the tubular element 15*b*, the bearing support 21*a* is supported by a flange extending radially between the bearing retainer 21 and the tubular element 15*b* and having a plurality of holes 22 running through it which are distributed around the bearing support 21*a* and are arranged to conduct cleaned crankcase gas past the bearing support 21*a* in the outlet duct 18*a*. A second end of the rotor shaft 10 is journalled by a second bearing 20*b'* in a wall element 21*b* disposed in the space 4' within the crankcase 5'.

The device described above and shown in the drawing works in the manner explained below for cleaning of crankcase gas from therein suspended particles (pollutants) which are of higher density than the gas. In this case the pollutants are of two kinds, viz. solid particles, e.g. soot particles, and liquid particles, e.g. oil particles.

The motor 19, 19' maintains rotation of the centrifuge rotor 3 within the space 4, 4'. Polluted crankcase gas in the space 4, 4' is led from an outer periphery of the stack of separating discs 6 directly into intermediate spaces 7 between the separating discs 6. From there, the gas flows radially inwards towards the central outlet chamber 11 of the rotor. While the gas is flowing between the separating discs 6, rotation is imparted to it by the rotation of the centrifuge rotor. The particles suspended in the gas are thus caused by the centrifugal force to move towards, and into contact with, the insides of the separating discs, i.e. the sides of the truncated conical separating discs which face towards the rotational axis R. Upon contact with the separating discs, the particles become entrained by them and are thereafter acted upon mainly by centrifugal forces which cause them to move radially outwards along the insides of the separating discs. When they reach the circumferential edges of the separating discs, the particles are propelled out from the centrifuge rotor 3 and are thus returned to the space 4, 4'.

The crankcase gas which has been relieved of particles in each intermediate space between neighbouring separating discs 6 continues to move radially inwards to the central outlet chamber 11 in the centrifuge rotor 3. However, the rotation of the centrifuge rotor results in flow resistance on the gas flowing through the intermediate spaces 7 between the separating discs 6. In other words, the centrifuge rotor 3 exerts a pumping action on the gas flow in a direction opposite to the desired direction of flow through the centrifuge rotor. If during operation the crankcase gas formed which is supplied to the space 4, 4' generates a high enough gas pressure therein, it will be caused, despite said flow resistance, to flow radially inwards towards the central outlet chamber 11 and out through the gas outlet 13'. However, the engine is so dimensioned that the pressure within the space 4, 4' needs to be kept within a specific pressure range, i.e. the pressure should not be allowed rise above a certain positive pressure, nor fall below a certain negative pressure. If the permissible positive pressure in the space 4, 4' is not sufficient to push the crankcase gas through the rotating centrifuge rotor, the device may be provided with said fan impeller 16 situated downstream of the centrifuge rotor to compensate for the pressure drop associated with the gas flow through the centrifuge rotor. The rotating fan impeller 16 thus draws crankcase gas through the centrifuge rotor 3 during operation. The cleaned crankcase gas leaves the outlet chamber 11 of the rotor 3 through the gas outlet 13, 13' and 13".

The invention is not confined to the embodiments referred to but may be varied and modified within the scope of the claims set out below. In the embodiments referred to, the centrifuge rotor is disposed horizontally in the space, but it may also be disposed vertically therein. Thus the centrifuge rotor may for example be arranged to hang in the valve cover via the rotor shaft and the bearing unit in the wall, or via the rotor shaft and the motor situated outside the space. The truncated conical separating discs may also be oriented with their inside facing either towards (as shown in the drawings) or away from the gas outlet. If they face away from the gas outlet, the first end wall 8 will instead be provided with a plurality of apertures running through it so that the central outlet chamber can communicate with the gas outlet in order to discharge cleaned gas from the centrifuge rotor.

What is claimed is:

1. A combustion engine comprising a device for cleaning of polluted gas within the combustion engine, the combustion engine comprising:

a space formed entirely within the combustion engine, the space formed entirely within the combustion engine having polluted gas therein and the space formed entirely within the combustion engine:

being in a location in which the polluted gas resides, and being defined by at least one internal wall of the combustion engine;

the device comprising:

a centrifugal separator for cleaning of the polluted gas, the polluted gas having suspended pollutants in the form of solid or liquid particles therein, the centrifugal separator comprising:

a centrifuge rotor which is rotatable about a rotational axis by a drive device and is arranged to cause the polluted gas to rotate, wherein the centrifuge rotor comprises a stack of truncated conical separating discs disposed at mutual spacing so that adjacent pairs of the truncated conical separating discs delimit intermediate spaces therebetween for the polluted gas to flow through, wherein the centrifuge rotor extends into the space formed entirely within the combustion engine along the rotational axis, an outlet chamber which is disposed centrally within the stack of truncated conical separating discs and communicates with said intermediate spaces, whereby the centrifuge rotor is configured for counterflow separation in such a way that the polluted gas is caused to rotate and is led into the intermediate spaces radially from outside the stack of truncated conical separating discs and radially inwardly towards the outlet chamber, and a gas outlet which communicates with the outlet chamber and is arranged to conduct cleaned gas from the centrifuge rotor, the stack of truncated conical separating discs on the centrifuge rotor is disposed for rotation entirely in the space formed entirely within the combustion engine and arranged to receive the polluted gas, the intermediate spaces communicating directly with the space formed entirely within the combustion engine, and the gas outlet is arranged to conduct the cleaned gas out of the space formed entirely within the combustion engine through the at least one internal wall; and an unimpeded flow path extending radially outward from the stack of truncated conical separating discs directly to the space formed entirely within the combustion engine in the location in which the polluted gas resides, the stack of truncated conical separating discs being configured to separate the suspended pollutants from the polluted gas, to move the suspended pollutants radially outward along the stack of truncated conical separating discs and to propel the suspended pollutants radially outward from an edge of the stack of truncated conical separating discs through the unimpeded flow path and directly into the space formed entirely within the combustion engine in the location in which the polluted gas resides.

2. The combustion engine according to claim 1, wherein the drive device is so arranged that the speed of the centrifuge rotor is variable relative to the speed of the combustion engine.

3. The combustion engine according to claim 1, wherein the drive device is a motor.

4. The combustion engine according to claim 1, wherein the drive device is situated outside the space.

5. The combustion engine according to claim 1, wherein a bearing unit is provided in the wall of the space formed entirely within the combustion engine to rotatably support the centrifuge rotor in the wall.

6. The combustion engine according to claim 5, wherein a further bearing unit is provided in the space formed entirely within the combustion engine, and the bearing unit and the further bearing unit are arranged to rotatably support the centrifuge rotor on the respective sides of the stack of truncated conical separating discs.

7. The combustion engine according to claim 4, wherein the centrifuge rotor is drivingly connected to the drive device via a rotor shaft which extends through a shaft lead-through in the at least one internal wall of the space formed entirely within the combustion engine, the shaft lead-through being configured with a bearing unit in the at least one internal wall.

8. The combustion engine according to claim 5, wherein the centrifuge rotor is rotatably supported only in said bearing unit in the at least one internal wall.

9. The combustion engine according to claim 5, wherein the gas outlet communicates with the outlet chamber via an axial end wall situated on the stack of truncated conical separating discs and disposed distally about said bearing unit.

10. The combustion engine according to claim 5, wherein the gas outlet communicates with the outlet chamber via an axial end wall situated on the stack of truncated conical separating discs and disposed proximally about said bearing unit.

11. The combustion engine according to claim 10, wherein the gas outlet has the form of a tubular element which surrounds said bearing unit and which is connected to the at least one internal wall of the space, the gas outlet forms an outlet duct in which a bearing support of the bearing unit is arranged in such a way that the cleaned gas can be conducted past the bearing support in the outlet duct.

12. The combustion engine according to claim 3, wherein the motor is an electric motor.

13. The combustion engine according to claim 3, wherein the motor is a hydraulic or pneumatic motor arranged to rotate the centrifuge rotor by means of a fluid which is pressurized by the combustion engine during operation.

14. The combustion engine according to claim 3, wherein the motor comprises a turbine disposed in the space formed entirely within the combustion engine and connected to the centrifuge rotor, and comprises a duct for supply of a pressurized fluid to an orifice situated in the space formed entirely within the combustion engine and directed towards the turbine in order to cause the turbine wheel and thereby the centrifuge rotor to rotate.

15. The combustion engine according to claim 14, wherein said pressurized fluid is a combustion engine lubricant.

16. The combustion engine according to claim 1, wherein the centrifugal separator comprises a fan situated downstream of the stack of truncated conical separating discs and adapted to compensating for a pressure drop associated with the polluted gas flow through the centrifuge rotor.

17. The combustion engine according to claim 16, wherein the fan is arranged in the gas outlet, the gas outlet being provided with a fan housing enclosing a fan impeller disposed on a rotor shaft of the centrifuge rotor and which extends into the fan housing.

18. The combustion engine according to claim 1, wherein the space formed entirely within the combustion engine is delimited by a cover of the combustion engine, the cover being at least one of a valve cover, a timing chain case or a flywheel housing.

19. The combustion engine according to claim 1, wherein the space formed entirely within the combustion engine is configured as a crankcase of the combustion engine or a space formed within an engine block in communication with the crankcase.

20. The combustion engine according to claim 1, wherein the flow path extends radially from an entire axial extent of the stack of truncated conical separating discs.

21. A combustion engine comprising a device for cleaning of polluted gas within the combustion engine, the combustion engine comprising:

a space formed entirely within the combustion engine, the space formed entirely within the combustion engine having polluted gas therein and the space formed entirely within the combustion engine:

being in a location in which the polluted gas resides, being defined by at least one internal wall of the combustion engine, being inside a crankcase of the combustion engine or inside an engine block in communication with the crankcase, and having an opening on an external surface of the crankcase or the engine block;

the device comprising:

a centrifugal separator for cleaning of the polluted gas, the polluted gas having suspended pollutants in the form of solid or liquid particles therein, the centrifugal separator comprising:

a centrifuge rotor which is rotatable about a rotational axis by a drive device and is arranged to cause the polluted gas to rotate, the drive device mounted in the opening and at least partially closing the opening, wherein the centrifuge rotor comprises a stack of truncated conical separating discs disposed at mutual spacing so that adjacent pairs of the truncated conical separating discs delimit intermediate spaces therebetween for the polluted gas to flow through, wherein the centrifuge rotor extends into the space formed entirely within the combustion engine along the rotational axis, an outlet chamber which is disposed centrally within the stack of truncated conical separating discs and communicates with said intermediate spaces, whereby the centrifuge rotor is configured for counterflow separation in such a way that the polluted gas is caused to rotate and is led into the intermediate spaces radially from outside the stack of truncated conical separating discs and radially inwardly towards the outlet chamber, and a gas outlet which communicates with the outlet chamber and is arranged to conduct cleaned gas from the centrifuge rotor, and the stack of truncated conical separating discs on the centrifuge rotor is disposed for rotation entirely in the space formed entirely within the combustion engine and arranged to receive the polluted gas, the intermediate spaces communicating directly with the space formed entirely within the combustion engine, and the gas outlet is arranged to conduct the cleaned gas out from the space formed entirely within the combustion engine through the at least one internal wall;

an unimpeded flow path extending radially outward from the stack of truncated conical separating discs directly to the space formed entirely within the combustion engine in the location in which the polluted gas resides, the stack of truncated conical separating discs being configured to separate the suspended pollutants from the polluted gas, to move the suspended pollutants radially outward along the stack of truncated conical separating discs and to propel the suspended pollutants radially outward from an edge of the stack of truncated conical separating discs through the unimpeded flow path and directly into the space formed entirely within the combustion engine in the location in which the polluted gas resides.

* * * * *